US011932443B2

(12) United States Patent
Feider et al.

(10) Patent No.: US 11,932,443 B2
(45) Date of Patent: Mar. 19, 2024

(54) PALLET STANDS

(71) Applicant: Target Brands, Inc., Minneapolis, MN (US)

(72) Inventors: Justin Feider, Minneapolis, MN (US); Jeff Hanson, Minneapolis, MN (US); Adam Stark, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 17/988,305

(22) Filed: Nov. 16, 2022

(65) Prior Publication Data

US 2023/0202711 A1 Jun. 29, 2023

Related U.S. Application Data

(60) Provisional application No. 63/293,427, filed on Dec. 23, 2021.

(51) Int. Cl.
*B65D 19/12* (2006.01)
*B65D 19/40* (2006.01)

(52) U.S. Cl.
CPC .... *B65D 19/40* (2013.01); *B65D 2519/00796* (2013.01)

(58) Field of Classification Search
CPC ..... B65D 19/40; B65D 2519/00796; B65D 2203/02; B65D 2203/06; B65D 2519/00024; B65D 2519/00293; B65D 2519/00348; B65D 2519/00273; B65D 2519/00288; B65D 2519/00815
See application file for complete search history.

(56) References Cited

U.S. PATENT DOCUMENTS 4,128,253 A * 12/1978 Powers ..... B65D 19/44 108/56.1
4,257,523 A * 3/1981 Blasio ..... B65D 19/44 211/49.1
4,279,204 A * 7/1981 Propst ..... B65D 19/0028 108/53.3
4,403,556 A * 9/1983 Van Gompel ..... B65D 19/44 108/55.3
4,887,537 A * 12/1989 Kellogg ..... B65D 77/0466 108/55.3
5,231,934 A * 8/1993 Good ..... B65D 19/38 108/54.1
5,408,937 A * 4/1995 Knight, IV ..... B65D 19/004 108/55.5
5,413,052 A * 5/1995 Breezer ..... B65D 19/0012 108/57.33
D380,762 S * 7/1997 Sammut ..... D15/89
6,688,573 B2 * 2/2004 Reed ..... A47B 87/0246 248/219.2

(Continued)

*Primary Examiner* — Amy J. Sterling
(74) *Attorney, Agent, or Firm* — Fish & Richardson P.C.

(57) ABSTRACT

Devices and systems can be used to enhance warehouse material handling operations. For example, this document describes pallet stands that make material handling processes more safe and efficient. In some embodiments, a pallet stand described herein includes a structure comprising a top configured for a pallet to rest on and a pedestal arranged to elevate the structure above a floor. The pedestal has an outer size that is less than the width of the top structure and less than the length of the top structure.

18 Claims, 5 Drawing Sheets

(56) References Cited

U.S. PATENT DOCUMENTS

| | | | | |
|---|---|---|---|---|
| 6,807,911 | B2 * | 10/2004 | Carson | B65D 19/0016 108/901 |
| 7,856,932 | B2 * | 12/2010 | Stahl | B65D 19/004 108/53.3 |
| 7,938,070 | B2 * | 5/2011 | Shea | B65D 19/0028 108/56.3 |
| 8,347,793 | B2 * | 1/2013 | Cummins | F16F 15/02 248/618 |
| 9,599,274 | B2 * | 3/2017 | Bullard | F16M 11/00 |
| 10,131,463 | B1 | 11/2018 | Elstone | |
| 10,266,158 | B2 * | 4/2019 | Wilson | B60S 9/04 |
| 11,697,524 | B2 * | 7/2023 | Daubenspeck | B65D 19/003 108/53.1 |
| 2004/0118725 | A1 * | 6/2004 | Shuert | B65D 19/0028 206/386 |
| 2011/0309228 | A1 | 12/2011 | Cox et al. | |
| 2013/0099071 | A1 | 4/2013 | Kauffman | |

* cited by examiner

PALLET STANDS

CROSS-REFERENCE TO RELATED APPLICATIONS

This application claims the benefit of U.S. Provisional Application Ser. No. 63/293,427, filed Dec. 23, 2021. The disclosure of the prior application is considered part of (and is incorporated by reference in) the disclosure of this application.

TECHNICAL FIELD

This document relates to devices and systems for enhancing warehouse material handling operations. For example, this document relates to pallet stands that make material handling processes more safe and efficient.

BACKGROUND

A pallet (sometimes referred to as a "skid") is a flat transport structure that supports goods in a stable fashion while being coupleable with material handling equipment such as forklifts, pallet jacks, front loaders, jacking devices, or scissors lifts. A pallet is the structural foundation of a unit load, which allows handling and storage efficiencies. Many pallets are made of wood. Others can be made of plastic, fiberboard, metal, various other types of materials, and combinations thereof.

Pallets are the primary interface of a unit load. They protect the product, absorb the stresses, hold the weight, encounter fork truck impacts, and safeguard goods traveling through the supply chain.

Today there are over 2 billion pallets in circulation. Over 500 million pallets are manufactured in the U.S. every year. Wooden pallets can be reused multiple times. With proper maintenance, a typical wooden pallet can be reusable up to nine times. Accordingly, the use of pallets in warehouses, transport devices, and elsewhere is ubiquitous.

SUMMARY

This document describes devices and systems for enhancing warehouse material handling operations. For example, this document describes pallet stands that make material handling processes more safe and efficient. In some embodiments, as described further below, a pallet stand includes a structure comprising a top configured for a pallet to rest on, and a pedestal arranged to elevate the structure above a floor. The pedestal has an outer size that is less than the width of the top structure and less than the length of the top structure.

In one aspect, this disclosure is directed to a pallet stand that includes a structure comprising a top configured for a pallet to rest on, the top having a width and a length; and a pedestal arranged to elevate the structure above a floor. The pedestal has an outer size that is less than the width of the structure and less than the length of the structure.

Such a pallet stand may optionally include one or more of the following features. The top may have a first edge and a second edge opposite of the first edge. The width may be defined between the first and second edge. The pedestal may be inset from the first edge and inset from the second edge. The top may have a third edge and a fourth edge opposite of the third edge. The length may be defined between the third and fourth edge. The pedestal may be inset from the third edge and inset from the fourth edge. The pedestal may be configured to rest on the floor. The top may be a planar surface. The structure may define two passageways configured to receive forks of a forklift. One edge of the structure may have a lip extending above the top. The lip may extend non-orthogonally in relation to the top. The lip may extend at a 30° to 60° angle in relation to the top. The pedestal may have an octagonal outer peripheral shape. The top may be a continuous planar surface. The top may be rectangular.

In another aspect, this disclosure is directed to another pallet stand that includes a rectangular upper surface configured for a pallet to rest on; and a single column extending below the upper surface and having a height whereby the upper surface is elevated above a floor.

Such a pallet stand may optionally include one or more of the following features. The column may have an outer peripheral size that is smaller than a length of the upper surface and smaller than a width of the upper surface. The pallet column may be centered in relation to a center of the upper surface. The column may have an octagonal outer peripheral shape. The column may have a circular outer peripheral shape. The column may have a polygonal outer peripheral shape.

The systems and processes described here may be used to provide one or more of the following optional advantages and/or benefits. First, worker safety enhancements can be provided by the systems and processes described herein. The need for manual lifting is reduced because of a raised pallet height. In addition, the manual tasks that workers need to perform for palletization and/or depalletization (or pallet down-stacking) are made more ergonomic by the systems and processes described herein. That is the case, for example, because of the elevated pallet height and because of toe-clearance space provided below the surface on which the pallets rest.

Second, labor costs associated with palletization and depalletization processes can be reduced using the pallet stands and processes described herein. Productivity is improved using the systems and processes described herein. That is, each worker can handle more boxes/items per hour using the systems and processes described herein.

Third, in some cases warehouse space requirements can be reduced using the systems and processes described herein. That is the case because the pallet stands described herein can be located closer to each other (arranged in a higher density) than conventional pallet handling techniques (e.g., without using pallet stands). The toe-clearance provided below the surface on which the pallets rest also benefits the use of material handling equipment such as pallet jacks and fork trucks. That is, the legs and wheels of such material handling equipment can travel into the clearance areas below the surface on which the pallets rest. Such clearance is one of the reasons that the pallet stands described herein can be arranged at a higher density than other conventional pallet handling equipment/techniques.

Fourth, the pallet stands described herein are configured to be readily portable, yet also configured to be affixed to a floor for a solid, stable pallet stand configuration.

Other features, aspects and potential advantages will be apparent from the accompanying description and figures.

DESCRIPTION OF DRAWINGS

Like reference symbols in the various drawings indicate like elements

DETAILED DESCRIPTION

This document describes devices and systems for enhancing warehouse material handling operations. For example, this document describes pallet stands that make material handling processes more safe and efficient. In some embodiments, as described further below, a pallet stand includes a structure comprising a top configured for a pallet to rest on, and a pedestal arranged to elevate the structure and the pallet above a floor. The pedestal has an outer size that is less than the width of the top structure and less than the length of the top structure.

Figure 1:
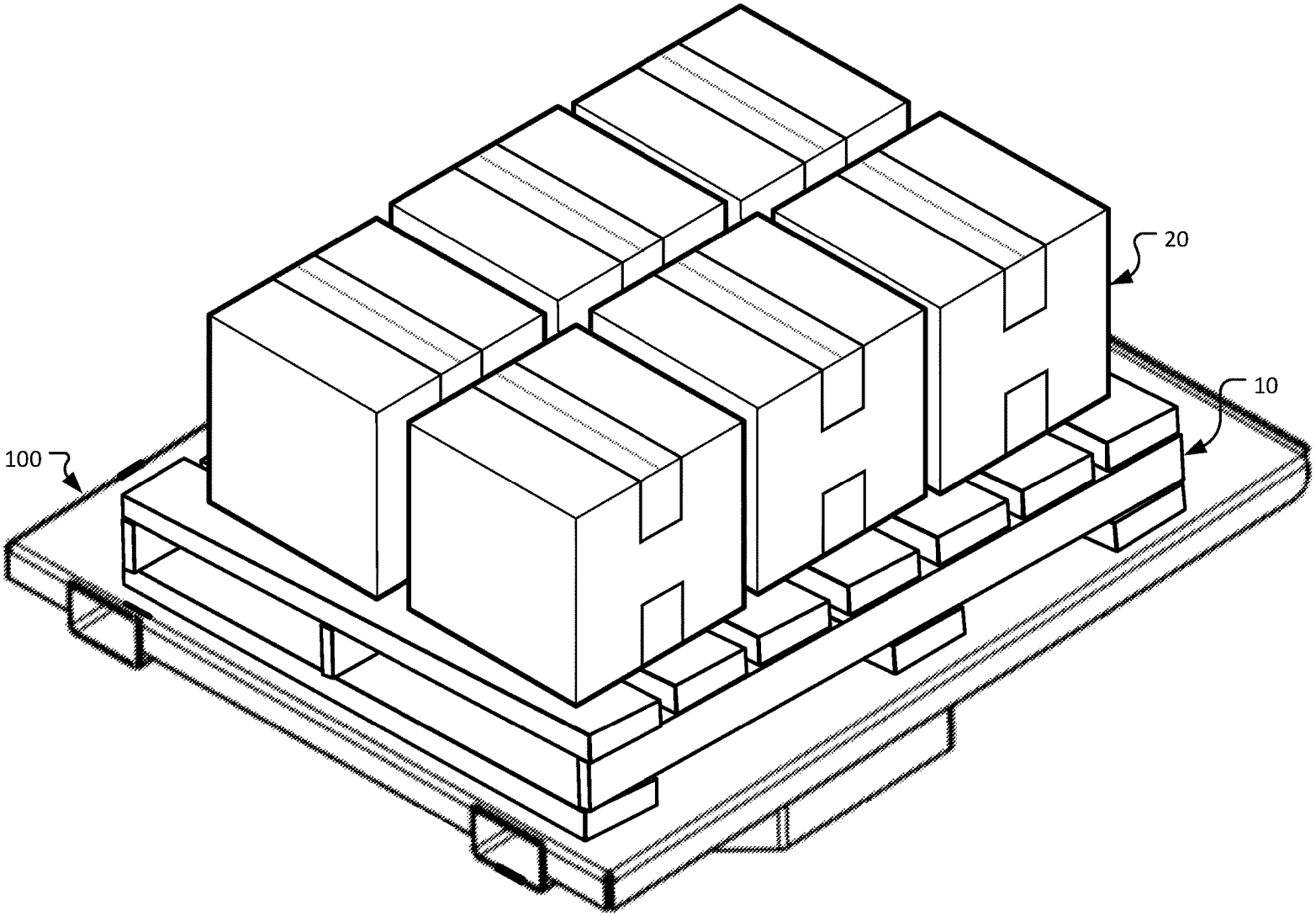
FIG. 1 depicts an example pallet stand and a pallet holding boxes in accordance with some embodiments.
Figure 2:
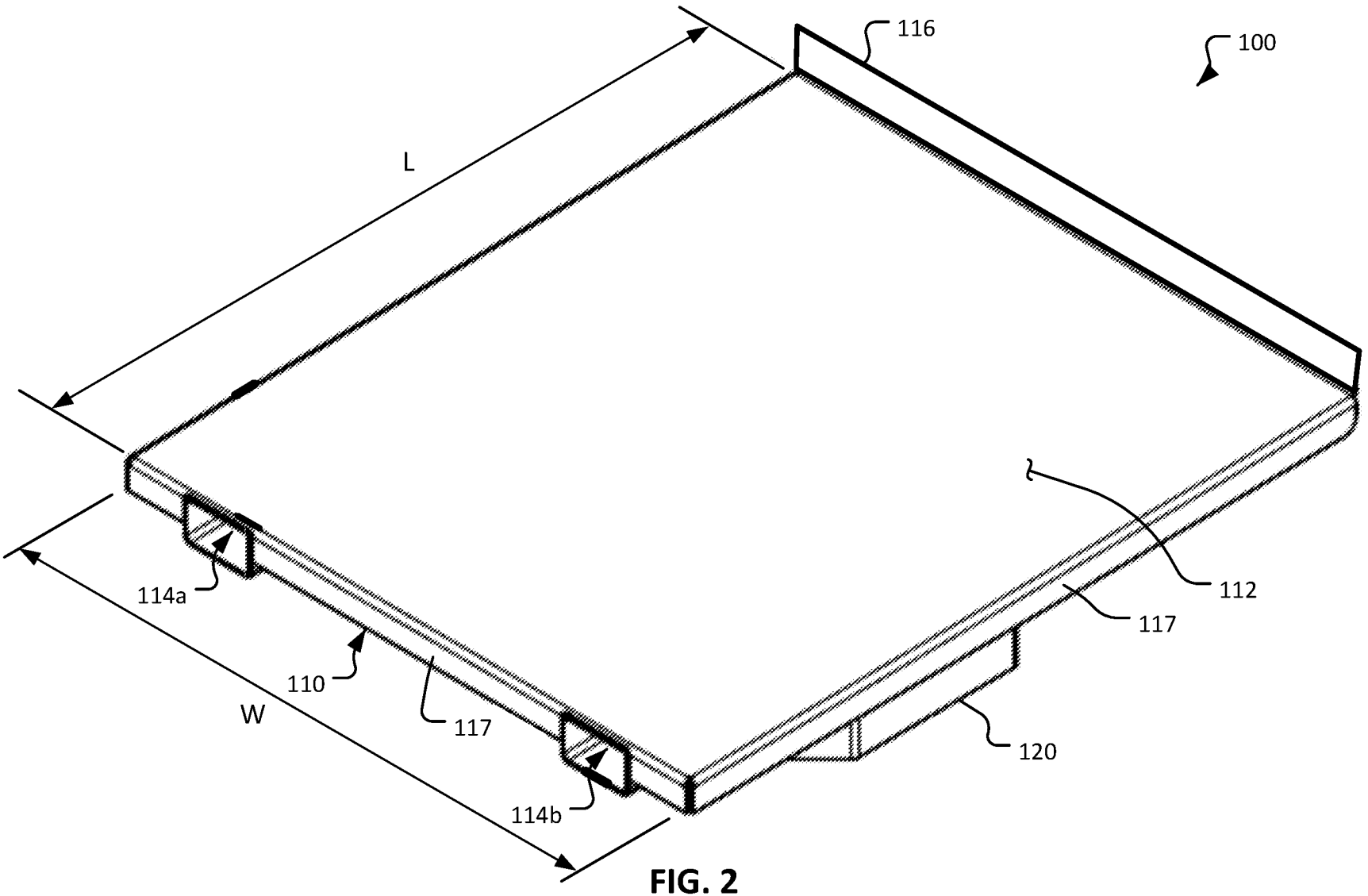
FIG. 2 is a perspective view of the example pallet stand of FIG. 1.

As shown in FIG. 1, an example pallet stand 100 can be used to support an example pallet 10 holding one or more boxes 20. Such an arrangement can be useful in many different scenarios. For example, in some cases the pallet stand 100 can be used to support the pallet 10 while various types of items such as, but not limited to, the boxes 20 are being loaded onto the pallet 10. In some cases the pallet stand 100 can be used to support the pallet 10 while the various types of items such as, but not limited to, the boxes 20 are being unloaded from the pallet 10. Such loading and/or unloading of the boxes 20 onto/from the pallet 10 can be performed fully manually (by a human worker), or using material handling equipment (e.g., a robot, a weight-balancing material handling device operated by a worker, etc.).

The example boxes 20 shown here represent any type of items such as, but not limited to, bins, bags, crates, totes, packages, containers, and any other suitable type of item. The pallet 10 can be placed onto, and thereafter rest on, the pallet stand 100 while the boxes 20 are being loaded onto the pallet 10, and/or while the boxes 20 are being off-loaded from the pallet 10. Afterwards, the pallet 10 (and sometimes including the boxes 20 on the pallet 10) can be removed from resting on the pallet stand 100.

Referring now also to FIGS. 2-5, some embodiments of the pallet stand 100 can include one or more of the following features described below. The features can be incorporated (or not) in the pallet stand 100 in any combination as desired.

The pallet stand 100 includes an upper structure 110 that includes a top 112 on which the pallet 10 can rest. The top 112 can be a planar surface. The top 112 can be a continuous planar surface, or can be discontinuous (e.g., made of multiple strips of metal, expanded metal, or combinations thereof in some embodiments).

In the depicted embodiment, the top 112 is rectangular. In some embodiments, the top 112 can be any other suitable shape such as, but not limited to, polygonal, square, octagonal, circular, and the like.

Figure 3:
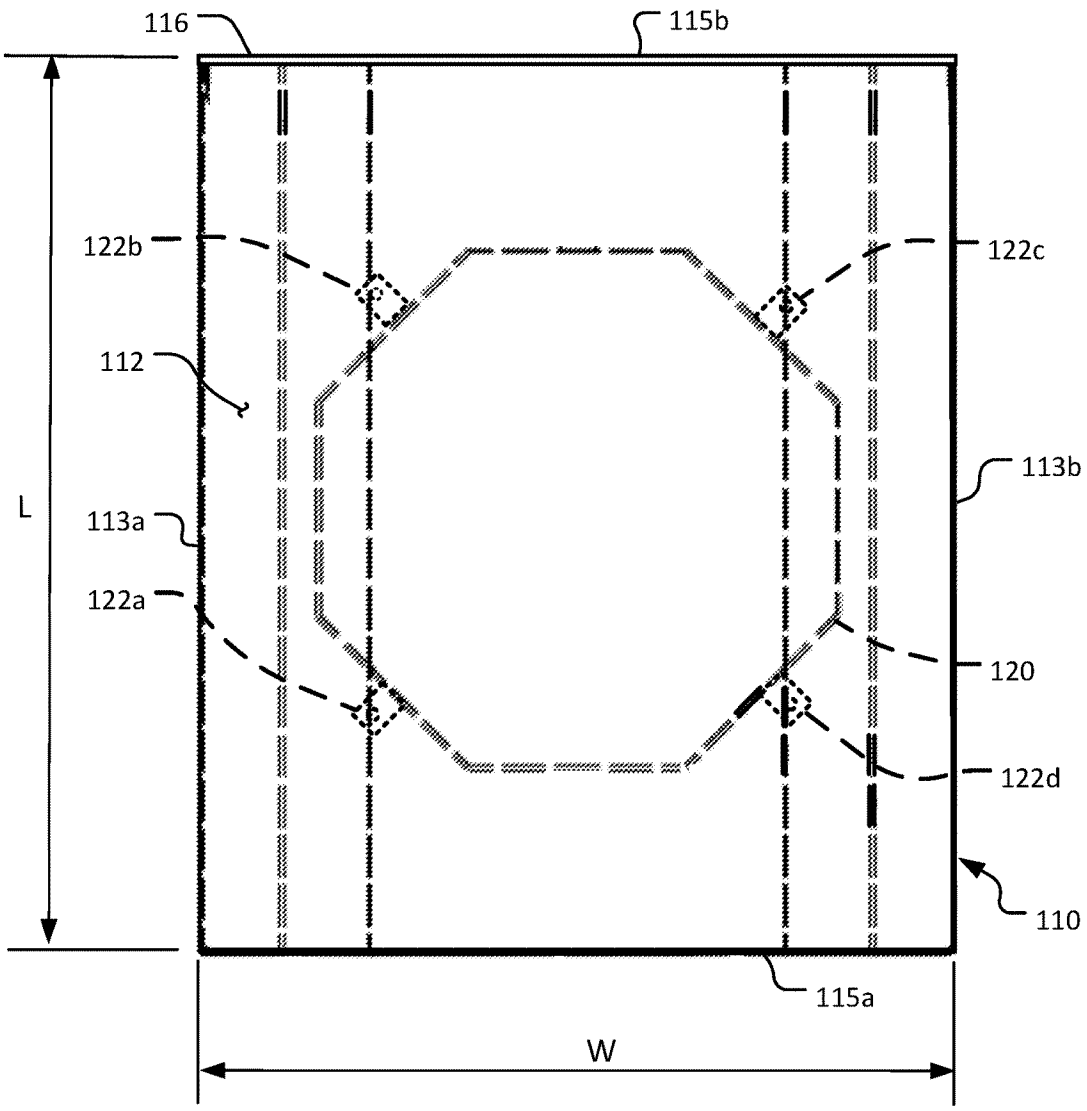
FIG. 3 is a top view of the example pallet stand of FIG. 1.

The top 112 has a width W and a length L. As shown in FIG. 3, the width W is defined between a first edge 113*a* of the top 112 and a second edge 113*b* of the top 112. The length L is defined between a third edge 115*a* of the top 112 and a fourth edge 115*b* of the top 112.

In some embodiments, one or more peripheral edges of the top 112 include(s) an impact bumper 117 that extends along the one or more peripheral edges of the top 112. Such an impact bumper 117 can be a soft, resilient material, for example, that provides protection for workers who might otherwise be injured (e.g., from a contusion to an ankle or shin) by accidentally impacting his/her leg into a hard metal peripheral edge surface of the top 112.

The pallet stand 100 includes a pedestal 120. The structure 110 that includes the top 112 (on which a pallet 10 can rest) is physically supported by the pedestal 120. Said another way, the pedestal 120 acts as a column to support the weight of the structure 110, pallet 10, and the contents of the pallet 10.

Figure 4:
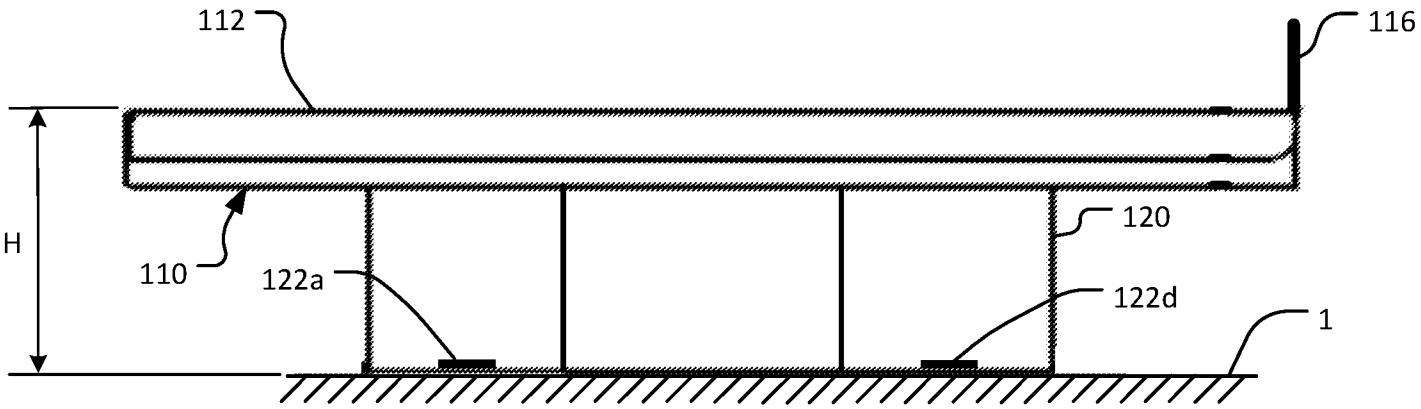
FIG. 4 is a first side view of the example pallet stand of FIG. 1.
Figure 5:
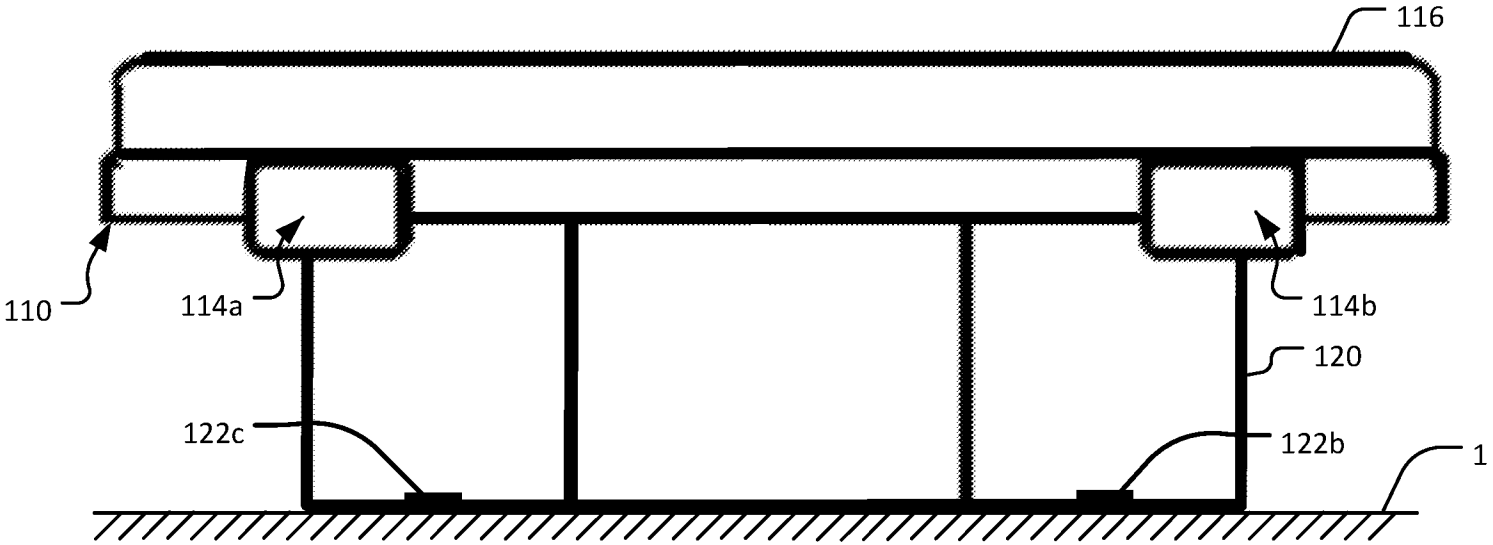
FIG. 5 is a second side view of the example pallet stand of FIG. 1.

As shown in FIGS. 3-5, the pedestal 120 is designed to rest on a secure surface such as a floor 1, plate, rotary turntable, or other surface. In the depicted embodiment, the pedestal 120 includes optional mounting feet 122*a*, 122*b*, 122*c*, and 122*d* by which the pedestal 120 can be affixed to the floor 1 or other mounting surface.

The pedestal 120 supports the structure 110, such that the top 112 is at a height H above the floor 1 (FIG. 4). In other words, the pedestal 120 is arranged to elevate the structure 110 and the top 112 above the floor 1. The height H can be any suitable distance. In some embodiments, the height H is in a range between 6 inches to 2 feet, or 1 foot to 3 feet, or 1 foot to 2 feet, without limitation. In some embodiments, the height H is user-adjustable. For example, a rack and pinion can be included by which the height H can be adjusted by a user.

In the depicted embodiment of the pallet stand 100, a single pedestal 120 is included. In some embodiments, two or more pedestals with smaller outer size profiles can be used in place of the single pedestal 120. In certain embodiments, the pedestal 120 can include a rotary union by which the structure 110 is rotatable in relation to the floor 1. Such a rotary union can latch in particular arrangements, and can be manually unlatched and rotated as desired.

As shown in FIG. 3, the pedestal 120 has an outer size that is less than the width W of the structure 110 and less than the length L of the structure 110. In particular, the pedestal 120 is inset from each of the first edge 113*a*, the second edge 113*b*, the third edge 115*a*, and the fourth edge 115*b* of the top 112. Accordingly, there is toe-clearance defined between the outer profile of the pedestal 120 and the outer profile of the structure 110. This toe-clearance beneficially allows workers to stand close to the structure 110, which makes the manual work of moving/lifting boxes 20 onto or off of the pallet 10 more ergonomic than without such toe-clearance. The toe-clearance also advantageously allows material handling equipment such as, but not limited to, forklifts to be able to get closer to the structure 110. Because of that, two of more of the pallet stands 100 can be located closer to each other than without such toe-clearance.

In the depicted embodiment, the pedestal 120 has an octagonal outer profile shape. In some embodiments, the pedestal 120 can have other outer profile shapes such as, but not limited to, circular, hexagonal, heptagonal, rectangular, square, triangular, polygonal, and the like. In some embodiments, the pedestal 120 is centered in relation to the top 112. Alternatively, in some embodiments the pedestal 120 is off center in relation to the top 112.

In some embodiments, the structure 110 includes two passageways 114*a* and 114*b*. The passageways 114*a-b* can be structural members (e.g., rectangular tubing) of the structure 110. In addition, the passageways 114*a-b* can define openings to receive the forks of a forklift truck. As a result, the pallet stand 100 can be readily transported while the forks of a forklift truck are in the passageways 114*a-b* and the pallet stand 100 is lifted off/above the floor 1.

As best seen in FIG. 4, in some embodiments (such as the depicted embodiment) the pallet stand 100 can include a lip 116 extending above the top 112. The lip 116 can provide an edge against which the pallet 10 can be located (e.g., for safety purposes). In addition, the lip 116 provides a surface on which labels can be printed or affixed. Various types of labels can be printed or affixed on/to the lip 116. For example, in some embodiments a barcode, QR code, and the like can be can be printed or affixed on/to the lip 116. Other types of labels such as words, numbers, symbols, etc. can also be printed or affixed on/to the lip 116.

In the depicted embodiment, the lip 116 extends orthogonally in relation to the top 112. In some embodiments, the lip 116 extends non-orthogonally in relation to the top 112. In particular embodiments, the lip extends at an angle in a range of 30° to 60° in relation to the top 112. In example embodiments, the lip extends at a 45° angle in relation to the top 112.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described herein as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described herein should not be understood as requiring such separation in all embodiments, and it should be understood that the described program components and systems can generally be integrated together in a single product or packaged into multiple products.

What is claimed is:

1. A pallet stand comprising:

a structure comprising a top configured for a pallet to rest on, the top having a width and a length; and one and only one pedestal arranged to elevate the structure above a floor, wherein the pedestal is configured to be mounted directly to the floor, wherein the pedestal has an outer size that is less than the width of the structure and less than the length of the structure, and wherein the structure defines two passageways configured to receive forks of a forklift.

2. The pallet stand of claim 1, wherein the top has a first edge and a second edge opposite of the first edge, and wherein the width is defined between the first and second edge.

3. The pallet stand of claim 2, wherein the pedestal is inset from the first edge and inset from the second edge.

4. The pallet stand of claim 3, wherein the top has a third edge and a fourth edge opposite of the third edge, and wherein the length is defined between the third and fourth edge.

5. The pallet stand of claim 4, wherein the pedestal is inset from the third edge and inset from the fourth edge.

6. The pallet stand of claim 1, wherein the top is a planar surface.

7. The pallet stand of claim 1, wherein one and only one edge of the structure comprises a lip extending above the top.

8. The pallet stand of claim 1, wherein the lip extends orthogonally in relation to the top.

9. The pallet stand of claim 1, wherein the lip extends at a 30° to 60° angle in relation to the top.

10. The pallet stand of claim 1, wherein the pedestal has an octagonal outer peripheral shape.

11. The pallet stand of claim 1, wherein the top is a continuous planar surface.

12. The pallet stand of claim 1, further comprising an impact bumper extending along one or more peripheral edges of the top.

13. A pallet stand comprising:

a structure comprising a rectangular upper surface configured for a pallet to rest on;

a lip extending above the upper surface along one and only one side edge of the upper surface; and one and only one column extending below the structure and having a height whereby the upper surface is elevated above a floor, wherein the structure defines two passageways configured to receive forks of a forklift.

14. The pallet stand of claim 13, wherein the column has an outer peripheral size that is smaller than a length of the upper surface and smaller than a width of the upper surface.

15. The pallet stand of claim 14, wherein the column is centered in relation to a center of the upper surface.

16. The pallet stand of claim 13, wherein the column has an octagonal outer peripheral shape.

17. The pallet stand of claim 13, wherein the column has a circular outer peripheral shape.

18. The pallet stand of claim 13, wherein the column has a polygonal outer peripheral shape.

* * * * *